US011147332B2

(12) United States Patent
Willinger

(10) Patent No.: US 11,147,332 B2
(45) Date of Patent: Oct. 19, 2021

(54) PROTECTIVE HELMET

(71) Applicants: Université de Strasbourg, Strasbourg (FR); Centre national de la recherche scientifique, Paris (FR)

(72) Inventor: Rémy Willinger, Eckbolsheim (FR)

(73) Assignees: UNIVERSITÉ DE STRASBOURG, Strasbourg (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 212 days.

(21) Appl. No.: 16/348,118

(22) PCT Filed: Nov. 7, 2017

(86) PCT No.: PCT/EP2017/078487
§ 371 (c)(1),
(2) Date: May 7, 2019

(87) PCT Pub. No.: WO2018/083345
PCT Pub. Date: May 11, 2018

(65) Prior Publication Data

US 2019/0357623 A1 Nov. 28, 2019

(30) Foreign Application Priority Data

Nov. 7, 2016 (FR) ..... 16 60753

(51) Int. Cl.
*A42B 3/06* (2006.01)
*A42B 3/08* (2006.01)

(52) U.S. Cl.
CPC ..... *A42B 3/064* (2013.01); *A42B 3/08* (2013.01)

(58) Field of Classification Search
CPC ..... A42B 3/064; A42B 3/08
(Continued)

(56) References Cited

U.S. PATENT DOCUMENTS 8,615,817 B2 * 12/2013 Phillips ..... A42B 3/064 2/411
8,776,272 B1 * 7/2014 Straus ..... A42B 3/003 2/411

(Continued)

FOREIGN PATENT DOCUMENTS

EP 2 428 129 A2 3/2012
WO WO 03/005844 A1 1/2003

OTHER PUBLICATIONS

International Search Report in PCT/EP2017/078487, dated Feb. 2, 2018.

*Primary Examiner* — Katherine M Moran
(74) *Attorney, Agent, or Firm* — Knobbe, Martens, Olson & Bear, LLP

(57) ABSTRACT

A protective helmet includes an inner cap, an outer cap and a decoupling layer capable of allowing the outer cap to rotate relative to the inner cap about any axis of rotation in the event of an impact. At least one spherical surface is completely contained in the decoupling layer. The helmet includes a fastening strap attached at two opposing points of the inner cap without any mechanical connection with the outer cap. The strap is intended to fasten the helmet to the head of the wearer. The helmet includes a fastening frame attached to the inner cap, and the strap is attached to the inner cap by the fastening frame.

21 Claims, 6 Drawing Sheets

(58) Field of Classification Search
USPC ..... 2/425
See application file for complete search history.

(56) References Cited

U.S. PATENT DOCUMENTS

| | | | | |
|---|---|---|---|---|
| 2009/0260133 | A1* | 10/2009 | Del Rosario | A42B 3/063 2/412 |
| 2013/0185837 | A1 | 7/2013 | Phipps et al. | |
| 2014/0259316 | A1* | 9/2014 | Katz | A42B 3/32 2/421 |
| 2015/0223547 | A1* | 8/2015 | Wibby | A42B 3/064 2/414 |
| 2016/0157548 | A1* | 6/2016 | Copeland | A42B 1/02 2/425 |
| 2018/0132556 | A1* | 5/2018 | Laperriere | A42B 3/121 |

* cited by examiner

PROTECTIVE HELMET

FIELD OF THE INVENTION

The present invention relates to a protective helmet comprising at least one inner cap intended to be placed in contact with the head of a wearer, an outer cap and a decoupling layer interposed between the inner cap and the outer cap, the decoupling layer being capable of allowing the outer cap to rotate relative to the inner cap about any axis of rotation in the event of an impact, at least one spherical surface extending to the periphery of the decoupling layer while being completely contained in the decoupling layer, the helmet comprising a fastening strap attached at least at two opposing points of the inner cap without any mechanical connection with the outer cap, the fastening strap being intended to fasten the helmet to the head of the wearer.

Such a helmet is in particular intended to protect the head of a user during impacts, in particular any oblique impacts that contain a radial and tangential component. It is in particular intended to be used on the road, when driving a two-wheeled vehicle, or during sport activities (essentially, but not limited to, motorcycle, e-bike, bicycle, ski, horseback).

BACKGROUND

During accidents involving one or several motorcyclists (or a cyclist), cranial trauma represents a significant portion of the observed injuries. This type of trauma occurs despite a high rate of helmet use.

Although there is no longer a need to prove the interest of wearing a helmet, improving the protective capabilities of helmets remains on the agenda, in particular to protect motorcyclists from impacts with a tangential component.

During an impact, when the head of a helmet wearer hits the ground or any other structure, the helmet generally undergoes a force having a component normal to the head of the wearer.

In most cases, in particular during an oblique impact on the ground, a sidewalk edge or any other obstacle, the force applied on the helmet also has a component tangential to the point of impact of the wearer's head.

The assembly formed by the head of the wearer and the helmet then experiences a linear acceleration produced by the normal component of the force, and a rotational (or angular) acceleration produced by the tangential component of the force.

The commercially available helmets typically protect effectively against linear acceleration, in particular against impacts at moderate speed and in sliding situations. The current protection standards, for example standard ECE-R 2205, are suitable for qualifying helmets in this type of situation, in terms of shock absorption.

However, the current helmets protect very little against rotational acceleration in case of oblique impact.

This is detrimental, since the rotational acceleration of the head has a particularly harmful effect on the intracerebral contents of the wearer.

In particular, no standard exists at this time to qualify the effectiveness of a helmet to protect from oblique impacts.

WO 2004/032659 describes a helmet having an inner cap, and an outer cap capable of separating by rotation from the inner cap, when an oblique impact occurs. Such a helmet has an improved protective behavior, but still leaves room for optimization.

The invention therefore aims to provide a helmet optimized in order to improve the protection of the head of the wearer both with respect to linear acceleration and rotational acceleration.

SUMMARY

The helmet is intended to be optimized with respect to brain injury criteria based on the elongation of axons as it is possible to calculate them using finite element models of the human head as described in Sahoo et al., 2016. These criteria will be called biomechanical injury criteria.

To that end, the invention relates to a protective helmet characterized in that the helmet includes a fastening frame attached to the inner cap, the fastening strap being attached to the inner cap by means of the fastening frame. The protective helmet may further have one or more of the features below, considered alone or according to any technical possible combination:

- the interface between the decoupling layer and the inner cap and the interface between the decoupling layer and the outer cap are spherical, or the decoupling layer has a spherical median surface;
- the inner cap has a thickness of between 5 mm and 15 mm;
- the decoupling layer has a thickness greater than 5 mm, and advantageously between 5 mm and 15 mm;
- the decoupling layer has a shear modulus of less than 2 MPa;
- the decoupling layer is made from expanded polystyrene having a density of less than 20 g/l, expanded polypropylene, polyethylene foam, polyurethane (PORON, PORON XRD, V10, SAF or D3O), cross-linked or non-cross-linked polyethylene, an extruded material such as IMPAX materials, or lastly viscoelastic gels;
- the decoupling layer is made from isotopic continuous material;
- the decoupling layer is made from anisotropic continuous material;
- the inner cap is formed from expanded polystyrene, a polyethylene foam, a polyurethane foam, a cross-linked polyethylene or a non-cross-linked polyethylene;
- the fastening frame is attached on the inner cap by gluing or overmolding or by periodic connections;
- the fastening frame is attached on an inner surface or on an outer surface of the inner cap;
- the fastening frame alternatingly passes over an outer surface of the inner cap and over an inner surface of the inner cap, or through the inner cap, within it;
- the fastening frame is a net or a weave or a membrane;
- an outer shell attached to the outer cap;
- the inner cap and the outer cap each respectively extend up to a peripheral free edge, the outer shell comprising a deformable and/or breakable coupling covering the free edges of the inner cap and the outer cap;
- the decoupling layer is a continuous layer arranged over the entire outer surface of the inner cap;
- the decoupling layer is discontinuous and includes studs extending between the inner cap and the outer cap;
- the outer cap is formed from expanded polystyrene, expanded polypropylene, a polyethylene foam, a polyurethane foam, a cross-linked polyethylene or a non-cross-linked polyethylene;
- the outer cap has a thickness of between 5 mm and 30 mm;
- the fastening strap comprises two parts connectable to one another and separable using an attachment system able to be actuated by the wearer, at least one of the parts comprising several branches connected to one another, said branches advantageously being attached on the inner cap, by means of the fastening frame, at a plurality of separate points, for example at four to six separate points;

the helmet includes at least one connecting element secured to the inner cap and the outer cap and passing through the decoupling layer, the connecting element being substantially longer than the thickness of the decoupling layer and having a modulus of elasticity of between 150 GPa and 250 GPa, in particular greater than 200 GPa, and a limit of elasticity of between 200 MPa and 270 MPa;

the decoupling layer is provided with holes;

the curve of the stress behavior law as a function of the deformation of the decoupling layer is defined in a corridor framed by a first curve and a second curve, the first curve having a slope of 0.5 MPa for a deformation of less than 0.1 (or 10%), a plateau at 0.05 MPa for a deformation of between 0.1 (10%) and 0.9 (90%), and a slope of 20 MPa for a deformation greater than 0.9 (90%), the second curve having a slope of 5 MPa for a deformation of less than 0.1 (or 10%), a plateau at 0.5 MPa for a deformation of between 0.1 (10%) and 0.5 (50%), and a slope of 10 MPa for a deformation greater than 0.5 (50%); and the decoupling layer has an elastic behavior for a deformation of less than 0.1 (10%), the Young's modulus being between 0.5 MPa and 5 MPa, the decoupling layer having a limit of elasticity of between 0.05 MPa and 0.5 MPa, the behavior law of the decoupling layer having a plateau for a deformation of between 0.1 (10%) and a limit value, the limit value being between 0.5 (50%) and 0.9 (90%), the behavior law having a slope of between 10 MPa and 20 MPa from said limit value.

BRIEF DESCRIPTION OF THE DRAWINGS

The invention will be better understood upon reading the following description, provided solely as an example and done in reference to the appended drawings, in which.

DETAILED DESCRIPTION

Figure 2:
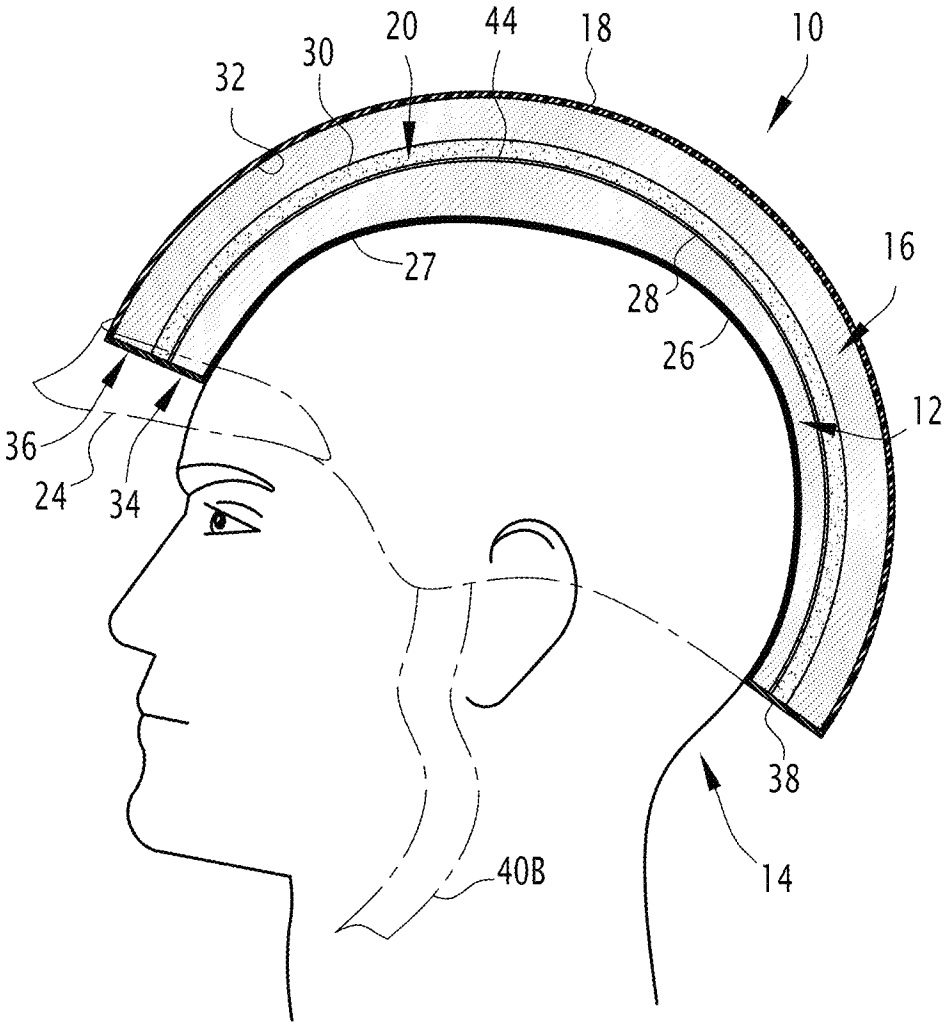
FIG. 2 is a sectional profile (or sagittal) view of the helmet of FIG. 1.
Figure 1:
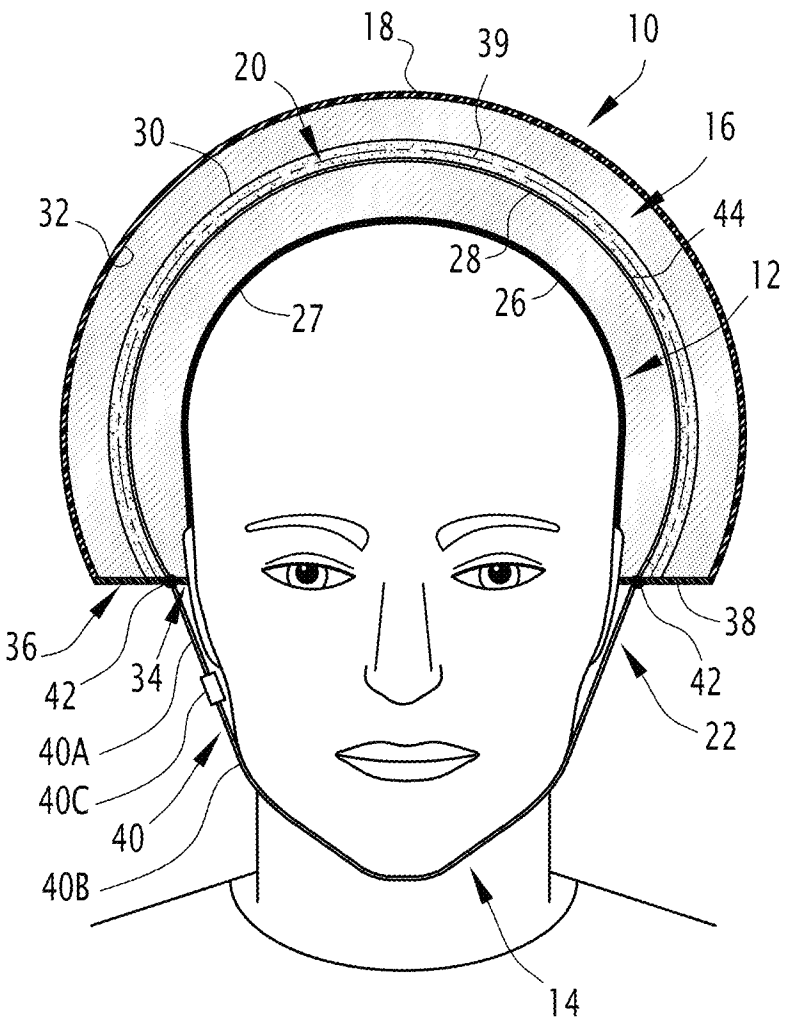
FIG. 1 is a sectional front (or frontal) view of a first helmet according to the invention.

A first protective helmet 10 according to the invention is illustrated in FIGS. 1 and 2.

Such a helmet 10 is intended to be used in particular, but non-limitingly, as a motorcyclist helmet, racecar driver helmet, e-bike helmet, bicycle helmet, horseback riding helmet, ski helmet, in-line skating helmet, captain's helmet, work helmet, or military helmet.

The protective helmet 10 comprises an inner cap 12 intended to be placed in contact with the head 14 of the wearer, an outer cap 16 and a decoupling layer 20 inserted between the inner cap 12 and the outer cap 16. In the embodiment of FIG. 1, the helmet 10 also optionally comprises an outer shell 18.

The helmet 10 further comprises a fastening device 22 (also called straps) for fastening the helmet 10 to the head 14 of the wearer. Here it comprises a visor 24 visible in FIG. 2 and which is optional.

This visor 24, if it exists, is preferably attached on the shell 18 or on the outer cap 16.

This visor is not attached on the inner cap 12.

Advantageously, the visor 24 is configured to separate from the helmet 10 in case of impact.

The inner cap 12 has an inner surface 26 intended to be placed in contact with the head 14 of the wearer, and an outer surface 28 placed in contact with the decoupling layer 20.

The inner cap 12 for example has a shape of variable thickness. The inner cap 12 has a thickness of between 5 mm and 25 mm. It may locally be thicker or thinner.

The inner surface 26 is suitable for marrying the shape of the apex of a user's skull. In one embodiment, between the head and the inner surface 26, the helmet 10 comprises a comfort layer 27. This comfort layer 27 has a thickness for example of less than 3 mm.

The outer surface 28 of the inner cap 12 fits in a sphere. The radius of the sphere is preferably between 50 and 130 mm, depending on the size of the helmet. This sphericity provides rotational decoupling about any rotation axis, as described later.

The inner cap 12 has elastoplastic or viscoelastic characteristics for example corresponding to the characteristics of an expanded polystyrene with density 20 g/l or 80 g/l. The inner cap 12 has a density advantageously of between 20 g/l and 80 g/l.

Figure 6:
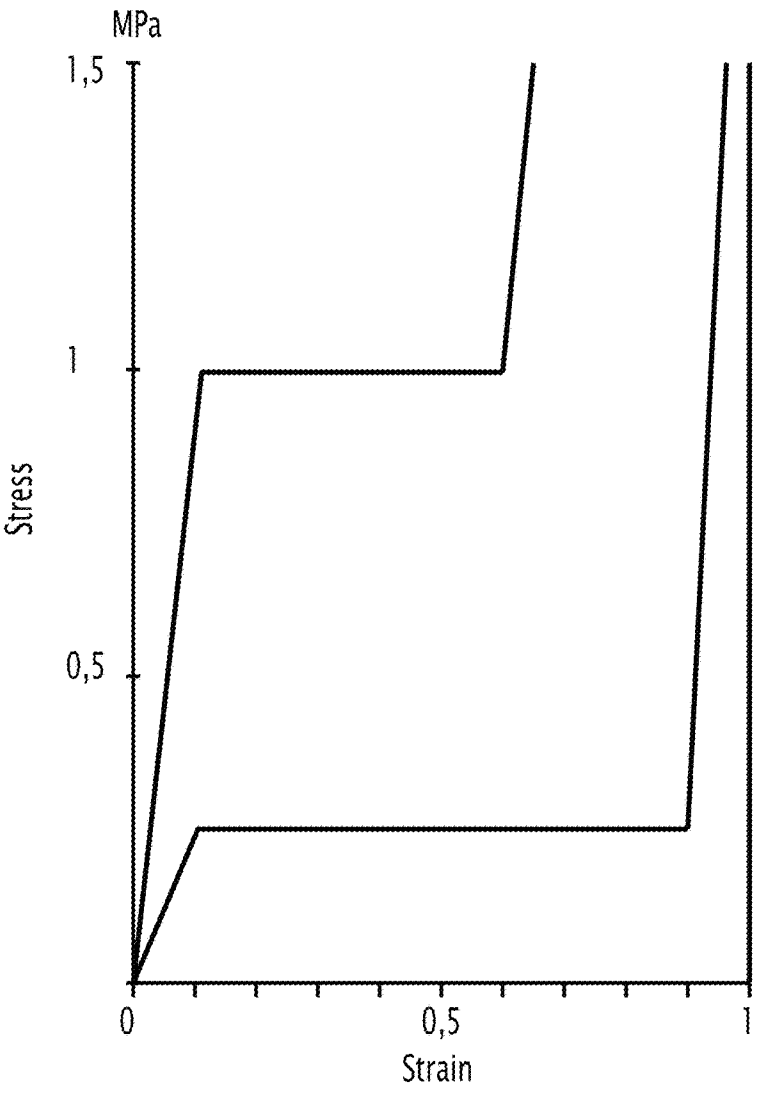
FIG. 6 shows behavior laws of the inner and outer caps.

FIG. 6 more precisely illustrates the characteristics of the material of the inner cap 12. More specifically, FIG. 6 illustrates a corridor of examples of stress behavior laws as a function of the deformation of the component material of the inner cap 12.

The curves of the stress behavior laws as a function of the deformation of the inner cap 12 are thus defined in the corridor framed by a first curve and a second curve visible in FIG. 6. The first curve has a slope of 2.5 MPa for a deformation of less than 0.1 (or 10%), a plateau at 0.25 MPa for a deformation of between 0.1 (10%) and 0.9 (90%), and a slope of 20 MPa for a deformation greater than 0.9 (90%). The second curve has a slope of 10 MPa for a deformation of less than 0.1 (or 10%), a plateau at 1 MPa for a deformation of between 0.1 (10%) and 0.6 (60%), and a slope of 10 MPa for a deformation greater than 0.6 (60%).

The inner cap 12 thus has an elastic behavior for a deformation for example of less than 0.1 (or 10%), the Young's modulus then being between 2.5 MPa and 10 MPa. The elastic limit of the inner cap 12 is for example between 0.25 MPa and 1 MPa. The behavior law of the inner cap 12 has a plateau for a deformation of between 0.1 (10%) or less and a limit value, the limit value being between 0.6 (60%) and 0.9 (90%) or more. From this value, the behavior law has a slope of between 10 MPa and 20 MPa.

The inner cap 12 is for example formed by a honeycomb structure, made from expanded polystyrene, expanded polypropylene, a polyethylene foam, a polyurethane foam, a cross-linked polyethylene or a non-cross-linked polyethylene.

The outer cap 16 has a layer that has an inner surface 30 intended to be placed in contact with the decoupling layer 20, and an outer surface 32, placed in contact with the outer shell 18 if it exists.

The inner surface 30 fits in a sphere. The radius of the sphere is preferably between 60 and 130 mm, depending on the size of the helmet 10.

The outer cap 16 for example has a substantially spherical shape with a constant thickness. Alternatively, it has a non-spherical shape with a variable thickness, but guaranteeing that a surface contained in the decoupling layer 20 is substantially spherical. This sphericity provides rotational decoupling about any rotation axis, as described later. The thickness of the outer cap 16 is between 5 and 30 mm.

The outer cap 16 has elastoplastic or viscoelastic characteristics for example corresponding to the characteristics of an expanded polystyrene with density 20 g/l or 80 g/l. The outer cap 16 has a density advantageously of between 20 g/l and 80 g/l.

The component materials of the outer cap 16 and the inner cap 12 are the same. Alternatively, they are different.

FIG. 6 more precisely illustrates the characteristics of the material of the outer cap 16. More specifically, FIG. 6 illustrates a corridor of examples of stress behavior laws as a function of the deformation of the component material of the outer cap 16.

Likewise, the curves of the stress behavior laws as a function of the deformation of the outer cap 16 are thus defined in the corridor framed by the first curve and the second curve visible in FIG. 6 and described above.

The outer cap 16 thus has an elastic behavior for a deformation for example of less than 0.1 (10%), the Young's modulus then being between 2.5 MPa and 10 MPa. The elastic limit of the outer cap 16 is for example between 0.25 MPa and 1 MPa. The behavior law of the outer cap 16 has a plateau for a deformation of between 0.1 (10%) or less and a limit value, the limit value being between 0.6 (60%) and 0.9 (90%) or more. From this value, the behavior law has a slope of between 10 MPa and 20 MPa.

The outer cap 16 is for example formed by a honeycomb structure, made from expanded polystyrene, expanded polypropylene, a polyethylene foam, a polyurethane foam, a cross-linked polyethylene or a non-cross-linked polyethylene.

The inner cap 12 and the outer cap 16 are for example made from an identical material. Alternatively, they are made from a different material.

The inner cap 12 and the outer cap 16 are intended primarily to absorb the normal (or radial) component of the force exerted on the helmet 10 during an impact.

The inner cap 12 and the outer cap 16 respectively extend up to a respective peripheral free edge 34, 36.

The outer shell 18, if it exists, is attached to the outer cap 16 on the outer surface 32 of said cap 16.

The outer shell 18 comprises a deformable and/or breakable coupling 38 covering the free edges 34 and 36 of the inner cap 12 and the outer cap 16, at the periphery of the outer shell 18. The coupling 38 is intended to break to separate the inner cap 12 from the outer cap 16 in case of impact. Alternatively, it is the outer 16 or inner 12 cap that comprises the coupling 38, at the periphery of the outer 16 or inner 12 cap.

The outer shell 18 is for example made from polycarbonate, acrylonitrile butadiene styrene, PVC, resin reinforced with glass fibers, carbon fibers or Kevlar.

The decoupling layer 20 is able to allow a rotational movement of the outer cap 16 relative to the inner cap 12 about any rotation axis, during an impact applied on the outer shell 18 (or to the outer cap 16 in the case where the outer shell 18 does not exist) due to its shear deformation).

Figure 3:
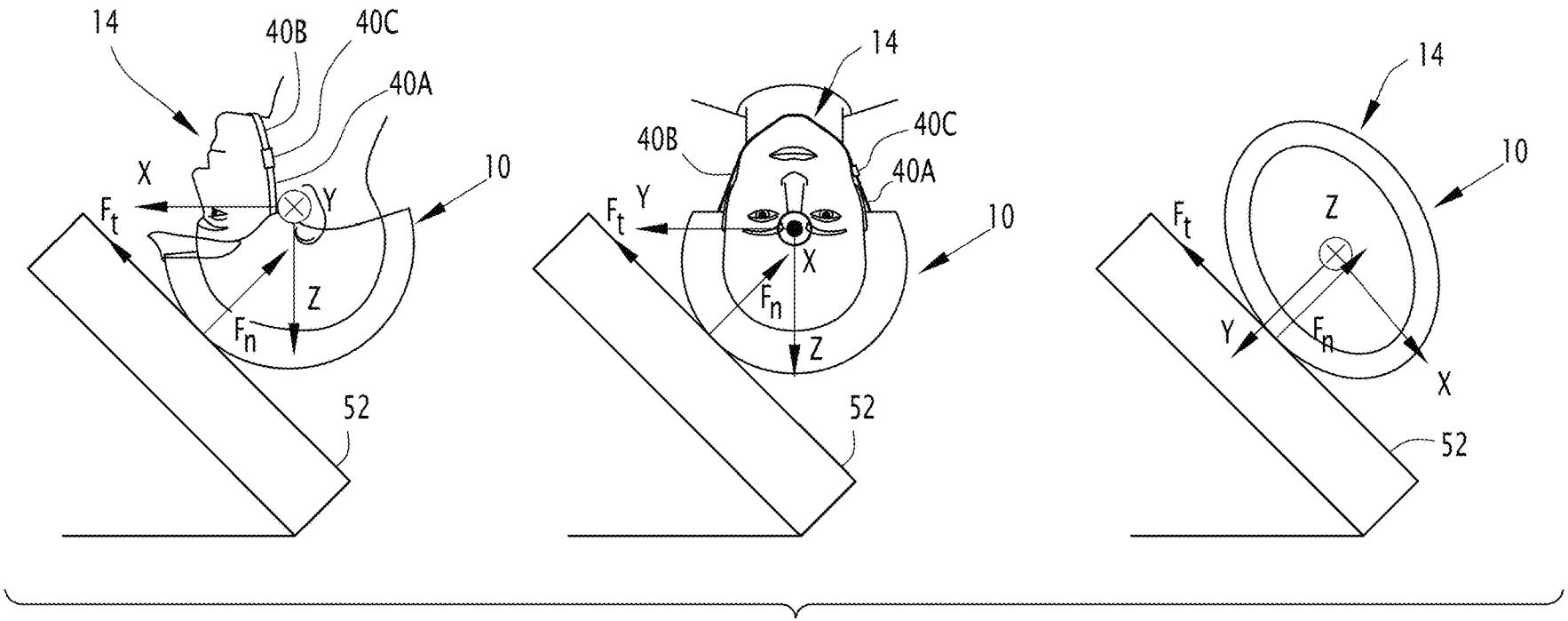
FIG. 3 is a view of three types of oblique impacts that the head of a wearer may experience in case of impact against an impact surface.

FIG. 3 is a sectional view of three types of oblique impacts with a rotational component about primary rotation axes that the head 14 of the wearer of the helmet 10 may experience.

One can thus see the axis denoted X, which corresponds to the posterior/anterior axis of the head 14, the axis denoted Y, which corresponds to the lateral left-right axis of the head 14, and the axis denoted Z, which corresponds to the vertical axis of the head 14.

Any rotation axis of the head 14 of the wearer can be expressed as a function of the axes X, Y and Z, the rotation about the axis Z being known as the most dangerous for the head 14 of the wearer.

To guarantee the rotational decoupling between the inner cap 12 and the outer cap 16 for any rotation axis, the decoupling layer 20 is configured so that at least one spherical surface 39 is fully contained in the decoupling layer 20 substantially at the center of the decoupling layer 20.

This spherical surface 39 extends to the periphery of the decoupling layer 20 while being fully contained in the decoupling layer 20.

In the specific example illustrated in FIGS. 1, 2, 4 and 5, the interfaces between the decoupling layer 20 and respectively the inner cap 12 and the outer cap 16 are spherical.

In the first embodiment of FIGS. 1 to 2, the decoupling layer 20 is an isotropic or anisotropic continuous layer arranged over the entire outer surface 28 of the inner cap 12.

The decoupling layer 20 has a thickness greater than 5 mm, and advantageously between 5 mm and 15 mm.

The decoupling layer 20 has elastoplastic or fragile viscoelastic mechanical properties with a low shear modulus. The shear modulus of the decoupling layer 20 is for example less than 2 MPa.

The decoupling layer has a density of between 10 g/l and 500 g/l.

Figure 7:
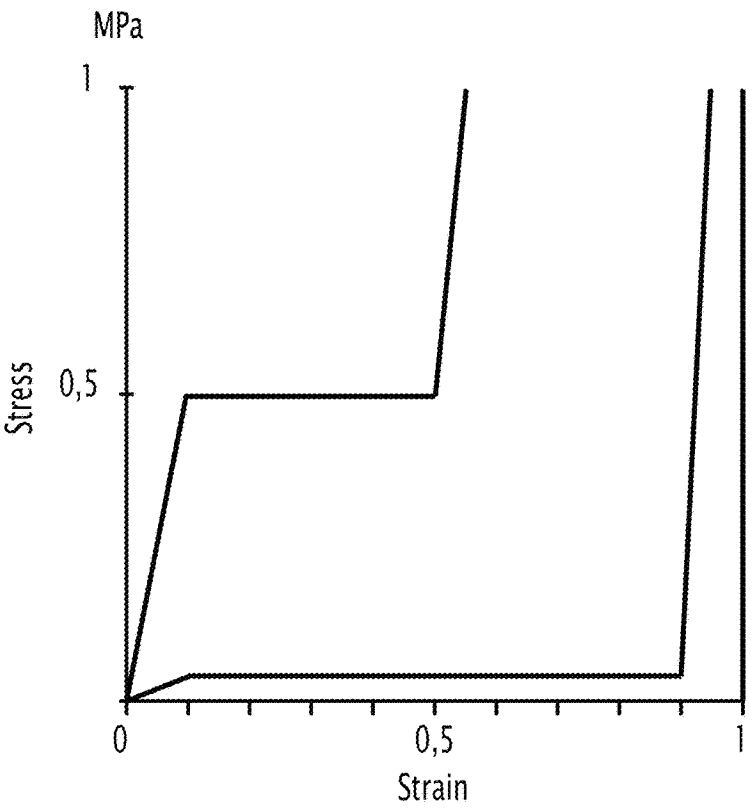
FIG. 7 shows behavior laws of the decoupling layer.

FIG. 7 more precisely illustrates the characteristics of the material of the decoupling layer 20. More specifically, FIG. 7 illustrates a corridor of examples of stress behavior laws as a function of the deformation of the component material of the decoupling layer 20.

The curves of the stress behavior laws as a function of the deformation of the decoupling layer 20 are thus defined in the corridor framed by a first curve and a second curve visible in FIG. 7. The first curve has a slope of 0.5 MPa for a deformation of less than 0.1 (or 10%), a plateau at 0.05 MPa for a deformation of between 0.1 (10%) and 0.9 (90%), and a slope of 20 MPa for a deformation greater than 0.9 (90%). The second curve has a slope of 5 MPa for a deformation of less than 0.1 (or 10%), a plateau at 0.5 MPa for a deformation of between 0.1 (10%) and 0.5 (50%), and a slope of 10 MPa for a deformation greater than 0.5 (50%).

The decoupling layer 20 thus has an elastic behavior for a deformation for example of less than 0.1 (10%), the Young's modulus then being between 0.5 MPa and 5 MPa. The elastic limit of the decoupling layer 20 is for example between 0.05 MPa and 0.5 MPa. The behavior law of the decoupling layer 20 has a plateau for a deformation of between 0.1 (10%) or less and a limit value, the limit value being between 0.5 (50%) and 0.9 (90%) or more. From this value, the behavior law has a slope of between 10 MPa and 20 MPa.

The decoupling layer 20 for example has a modulus of resistance of less than 2 MPa.

The decoupling layer 20 is for example made from expanded polystyrene having a density of less than 20 g/l, expanded polypropylene, polyethylene foam, polyurethane (PORON, PORON XRD or V10, SAF or D3O), cross-linked or non-cross-linked polyethylene, an extruded material such as IMPAX materials, or lastly fragile viscoelastic gels, such as cross-linked polyurethane gels, or polyurethane gels and foams, silicon gels, without being limited thereto. Fragile viscoelastic gels are particularly suitable.

The fastening device 22 includes a fastening strap 40 comprising two parts 40A and 40B able to be connected to one another and separable using a fastening system 40C able to be actuated by the wearer.

The fastening strap 40 is intended to fasten the helmet 10 to the head 14 of the wearer. The fastening strap 40, more specifically each part 40A, 40B, is thus attached to the inner cap 12 of the helmet 10 at least at two opposite points 42 of the inner cap 12, without mechanical connection to the outer cap 16, the two points 42 in particular being opposite relative to the head 14 of the wearer.

In the example illustrated in FIGS. 1 and 2, each part 40A, 40B is formed by a single branch.

More specifically, the fastening device 22 includes a rigid fastening frame 44 attached to the inner cap 12, the fastening strap 40 being attached to the inner cap 12 by means of the fastening frame 44. The strap 40 is thus connected to the frame 44 at opposite points 42, or along the entire surface 28.

The fastening frame 44 is for example discontinuous, such as a net or a weave. Alternatively, the fastening frame 44 is a continuous layer.

The frame 44 for example has a thickness of between 0.5 mm and 2.0 mm.

The frame 44 is for example made from strong fabric or a membrane made from polycarbonate, acrylonitrile butadiene styrene, PVC, or nylon fabric, without being limited thereto.

The fastening frame 44 is attached on the inner cap 12 by gluing or overmolding. Alternatively, the fastening frame 44 is attached on the inner cap 12 by periodic connections.

In the example illustrated in FIGS. 1 and 2, the fastening frame 44 is attached on the outer surface 28 of the inner cap 12.

The operation of this helmet 10 according to the invention will now be described.

During an impact between an impact surface 52 and the assembly formed by the head 14 of the wearer and the helmet 10, illustrated in FIG. 3, the helmet 10 experiences a force including a component Fn normal to the impact surface 52 and a component Ft tangential to the impact surface 52.

It should be noted that the speed of the considered impact [is] between 6.5 m/s and 10.5 m/s for the motorcycle helmet and 4.5 m/s and 8.5 m/s for bicycle, e-bike or sports (horseback riding, ski, skating, etc.) helmets. In all, the mechanical properties of the helmet are optimized on the biomechanical injury criterion for these oblique impacts, as well as for linear impacts as stipulated by the various standards and regulations.

The normal component Fn exerted on the outer shell 18 (or on the outer cap 16 in the case where the outer shell 18 does not exist) causes an impact, and more specifically a linear acceleration of the head, which is damped and distributed by the outer 16 and inner 12 caps, and to a lesser extent by the crushing of the decoupling layer 20. The tangential component Ft causes a rotational acceleration of the helmet 10 by setting the assembly formed by the outer shell 18 and the outer cap 16 in rotation about any axis of rotation expressed as a function of the axes X, Y and Z.

The coupling 38, if it exists, covering the free edges 34 and 36 of the inner cap 12 and the outer cap 16 deforms or breaks under the effect of the rotation of the assembly formed by the outer shell 18 and the outer cap 16, under the effect of the sliding deformation of the decoupling layer 20.

The inner cap 12 and the outer cap 16 are then decoupled in rotation and are movable relative to one another along any rotation axis and in particular along the rotation axis caused by the tangential component Ft.

The fastening device 22 keeping the inner cap 12 secured in rotation with the head by means of the fastening frame 44 and the straps 40, the decoupling layer 20 then absorbs the rotational energy, the inner cap 12 and therefore the head 14 of the wearer thus experiencing a rotational acceleration weaker than that experienced by the outer cap 16.

In a variant (not shown), the coupling 38 of the outer shell 18 covers the free edge 36 of the outer cap 16 without covering the free edge 34 of the inner cap 12.

In a variant (not shown), the helmet 10 has no outer shell 18.

In a variant (not shown), the helmet 10 has no deformable coupling 38.

In a variant (not shown), the inner cap 12 is locally nonexistent on the periphery of the helmet 10.

In a variant (not shown), the fastening frame 44 is made up of a local reinforcement of the inner cap 12 at fastening points 42.

In a variant (not shown), the fastening frame 44 is attached to the inner surface 26 of the inner cap 12.

In a variant (not shown), the helmet 10 has no fastening frame and the parts of the strap are then attached directly on the inner cap 12 at the fastening points 42.

Figure 4:
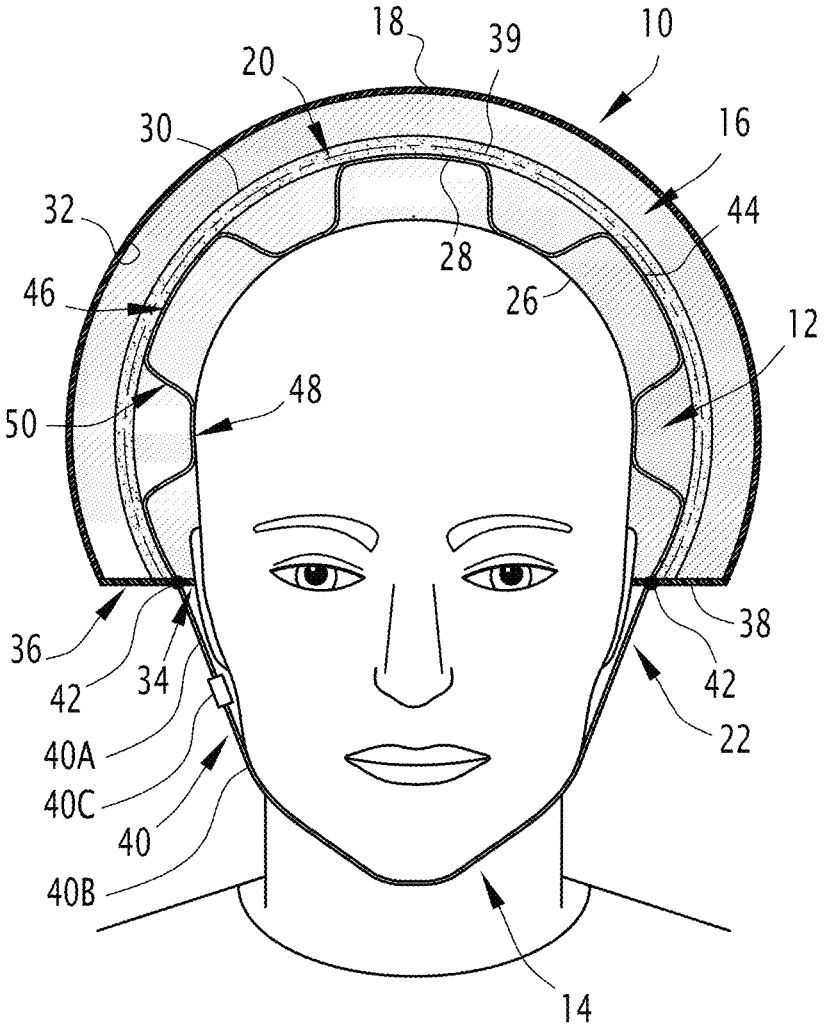
FIG. 4 is a sectional front view of a second helmet according to the invention.

In another variant illustrated in FIG. 4, the fastening frame 44 passes alternatingly over the outer surface 28 of the inner cap 12 and over the inner surface 26 of the inner cap 12.

The fastening frame (or the net, or the strap) 44 thus comprises parts 46 overlapping the outer surface 28 of the inner cap and parts 48 overlapping the inner surface 26 of the inner cap 12.

Between these parts 46 and 48, the fastening frame 44 comprises parts 50 passing through the inner cap 12 and thus attached to the inner layer 12.

In FIG. 4, the fastening frame 44 thus for example has a part 46 at the free edge 34 of said inner cap 12. More specifically, the fastening points 42 are located at the outer surface 28 of the inner cap 12. In a variant, the fastening frame 44 has a part 48 at the free edge 34, the fastening points 42 being located more specifically at the inner surface 26 of the inner cap 12.

Advantageously and in order to guarantee great rotational stability of the layer 12 on the head 14 of the user, the fastening points 42 of the strap 40A are located symmetrically in front of the ears, behind the ears, and/or symmetrically, toward the occipital zone.

In a variant that is not shown, the frame 44 (or the strap) can overlap only the outer surface 28 or the inner surface 26 without overlapping the other inasmuch as it would then stay within the inner cap 12 in a substantially median zone.

Figure 5:
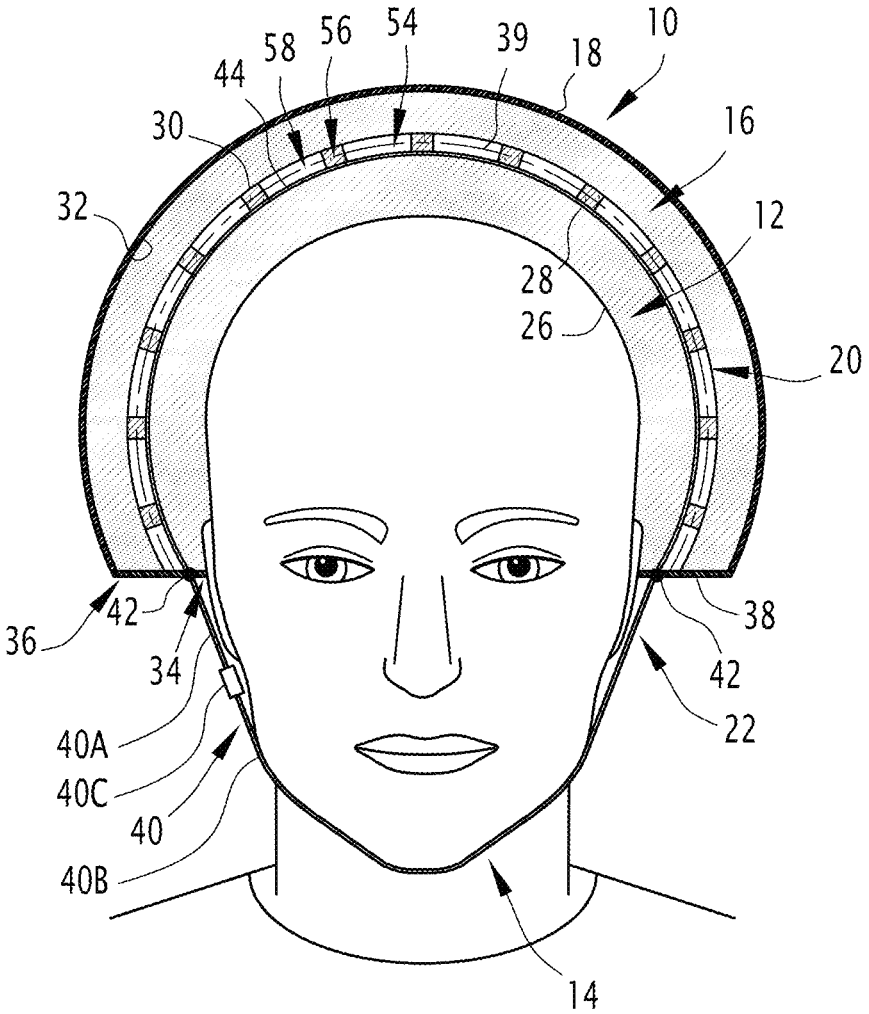
FIG. 5 is a sectional front view of a third helmet according to the invention.

In a variant illustrated in FIG. 5, the decoupling layer 20 is discontinuous. The inner cap 12 and the outer cap 16 then delimit a cavity 54.

The decoupling layer 20 includes studs 56 extending, in the cavity 54, between the inner cap 12 and the outer cap 16.

The studs 56 are for example cylindrical members, the ends of which are attached to the inner cap 12 and the outer cap 16.

Each stud 56 has a thickness comprised between 5 mm and 15 mm. Each stud 56 advantageously has elastoplastic or fragile viscoelastic properties close to those of the decoupling layer 20. Each stud 56 advantageously has a density of between 10 g/l and 500 g/l.

Each stud 56 for example has a modulus of resistance of less than 2 MPa. Each stud 56 for example has a modulus of elasticity from less than 0.5 MPa to 5 MPa.

Each stud 56 is for example made from expanded polystyrene having a density of less than 20 g/l, expanded polypropylene, polyethylene foam, polyurethane (PORON, PORON XRD, V10, SAF or D3O), cross-linked or non-cross-linked polyethylene, an extruded material such as IMPAX materials, or lastly fragile viscoelastic gels, such as cross-linked polyurethane gels, or polyurethane gels and foams, silicon gels, without being limited thereto. Fragile viscoelastic gels are particularly suitable.

Such a helmet 10 has multiple advantages to protect the head 14 of the wearer against significant linear and rotational accelerations, in particular against rotational accelerations of the head 14 along its vertical axis Z, which are particularly harmful.

In particular, by attaching the fastening strap 40 to the frame 44 and providing a deformable coupling 38 between the free edges of the inner cap 12 and the outer cap 16, the invention allows effective rotational decoupling of the two caps 12 and 16 along any rotation axis, which will result in reducing the rotational acceleration of the head.

Figure 9:
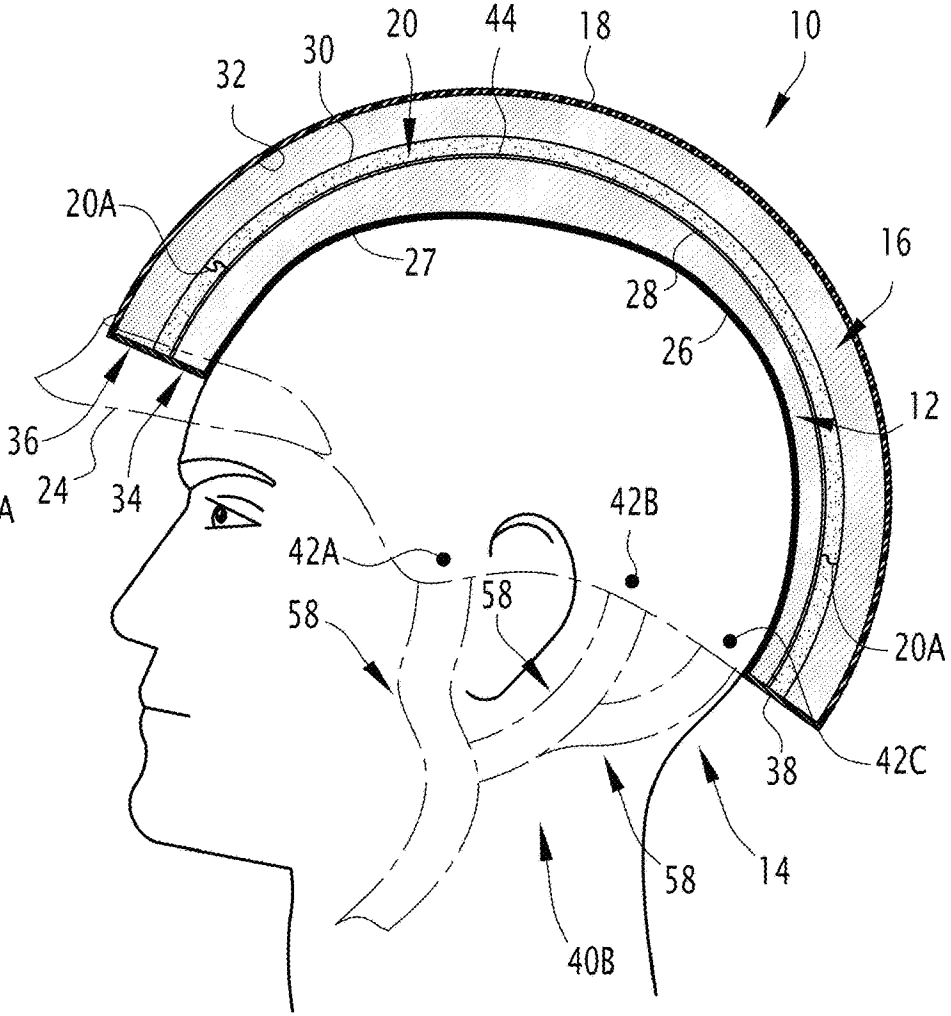
FIG. 9 is a sectional profile view of the helmet of FIG. 8.
Figure 8:
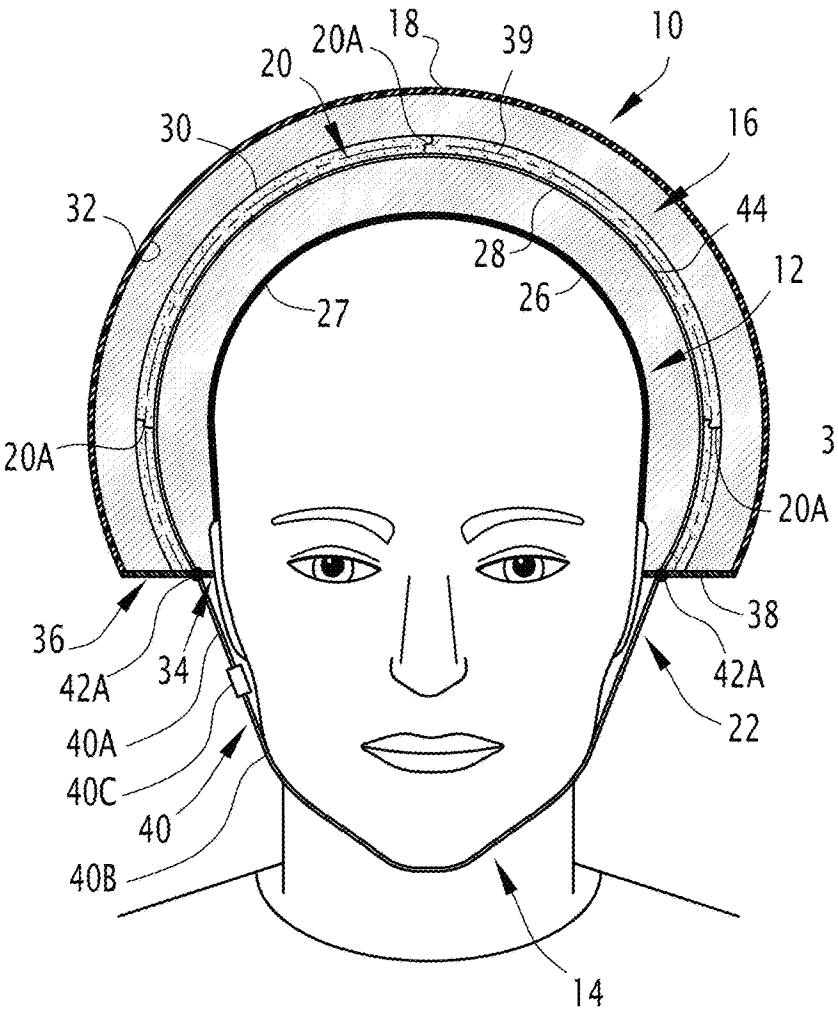
FIG. 8 is a sectional front view of a third helmet according to the invention.

A variant of the helmet 10 is illustrated in FIGS. 8 and 9.

Since this decoupling layer 20 is made from a material with a low modulus and low strength, it may prove necessary to keep the outer cap 16 on the helmet 10 in case of severe oblique impact while allowing decoupling and in order for the outer cap 16 not to separate completely from the helmet 10.

In the example illustrated in FIGS. 8 and 9, the helmet 10 comprises the inner cap 12 and the outer cap 16, which, following this violent oblique impact, is able to protect the head 14 of a user in case of second impact.

Furthermore, the helmet 10 then comprises at least one connecting element 20A with play.

In one preferred configuration, the helmet 10 comprises five connecting elements 20A.

Each connecting element 20A is a loose connection or a connection with play secured to the inner cap 12 and the outer cap 16 and passing through the decoupling layer 20.

In one embodiment that is not shown, each connecting element 20A passes through the inner cap 12 and the outer cap 16 and is secured to the inner cap 12 and the outer cap 16 by means of a button-type fastening abutting respectively against the outer surface 32 of the outer cap 16 and the inner surface 26 of the inner cap 12, the buttons framing the outer cap 16, the decoupling layer 20, and the inner cap 12. In a variant that is not shown, each connecting element 20A is extended on either side by tabs, one tab being glued to the outer surface 28 or to the inner surface 26 of the inner cap 12 and the other tab being glued to the outer surface 32 or to the inner surface 30 of the outer cap 16.

These preferred descriptions are not limiting, and other solutions for connecting elements 20A can be considered.

Each connecting element 20A allows a maximal relative movement between the inner cap 12 and the outer cap 16 of between 1 mm and 15 mm in all rotational decoupling directions, or a relative rotation of about 2 to 25°, depending on the geometry of the helmet.

Each connecting element 20A is for example a wire or a cable with a diameter of between 0.2 and 2 mm.

Each connecting element 20A has a modulus of elasticity of between 150 GPa and 250 GPa, in particular greater than 200 GPa, and a limit of elasticity of between 200 MPa and 270 MPa.

Each connecting element 20A is stressed in traction.

Each connecting element 20A is substantially longer than the thickness of the decoupling layer 20.

The component material of these connecting elements 20A can be a polymer or a steel or any other material with a modulus of elasticity and strength high enough to guarantee the integrity of the helmet 10, but low enough to potentially contribute to dissipating additional rotational energy.

The optimization of these connecting elements 20A will be done on biomechanical criteria as a function of the geometry of the helmet 10 and its field of application.

In case of high-energy oblique impact, the complete separation of the outer cap 16 relative to the inner cap 12 is prevented by the connecting elements 20A and the helmet is then able to protect the head in case of second impact.

In the embodiment of FIGS. 8 and 9, the part 40A of the strap 40 comprises several branches 58 connected to one another.

These branches 58 are advantageously attached on the inner cap 12, by means of the fastening frame 44, at a plurality of separate points 42A, 42B, 42C, for example at four to six separate points, in order to guarantee rotational stability of the inner cap 12 on the head 14 of the user.

In the variant of the helmet 10 with no fastening frame, these branches 58 are attached directly to the inner cap 12 without going through a fastening frame 44.

As illustrated in FIG. 9, these points can be distributed symmetrically two in front of the ears and two behind the ears, and/or may or may not be symmetrical, at one or two points in the occipital zone.

Additionally, not shown, the part 40B of the strap 40 comprises several branches. These branches are advantageously attached on the inner cap 12, by means of the fastening frame 44, at a plurality of separate points 42A, 42B, 42C, for example at four to six separate points, in order to guarantee rotational stability of the inner cap 12 on the head 14 of the user.

In a variant that is not illustrated, the decoupling layer 20 is a continuous material, but provided with holes.

The holes have a larger size of between 2 mm and 10 mm. The section of these holes is for example circular or rectangular, but may typically assume other geometries.

The distribution of these holes is homogeneous over the decoupling layer 20. In a variant, the decoupling layer 20 has zones with a higher density of holes than the rest of the layer.

The number, the distribution and the dimensions of these holes will be adjusted in the context of optimizing the device as a function of the materials present, the dimensions of the helmet 10 and its field of application.

These holes make the decoupling layer 20 more flexible and help the material of the decoupling layer 20 deform by shearing.

What is claimed is:

1. A protective helmet comprising at least one inner cap configured to be placed in contact with the head of a wearer, an outer cap and a decoupling layer interposed between the inner cap and the outer cap, the decoupling layer being capable of allowing the outer cap to rotate relative to the inner cap about any axis of rotation in the event of an impact, at least one spherical surface extending to the periphery of the decoupling layer while being completely contained in the decoupling layer, the helmet comprising:

a fastening strap attached at least at two opposing points of the inner cap without any mechanical connection with the outer cap, the fastening strap being configured to fasten the helmet to the head of the wearer; and a fastening frame attached to the inner cap, the fastening strap being attached to the inner cap by the fastening frame, wherein the inner cap has an outer surface and the outer cap has an inner surface, the decoupling layer being a continuous layer contacting the entire outer surface of the inner cap and contacting the entire inner surface of the outer cap.

2. The helmet according to claim 1, wherein the interface between the decoupling layer and the inner cap, and the interface between the decoupling layer and the outer cap are spherical, or the decoupling layer has a spherical median surface.

3. The helmet according to claim 1, wherein the inner cap has a thickness of between 5 mm and 15 mm.

4. The helmet according to claim 1, wherein the decoupling layer has a thickness greater than 5 mm, and/or has a shear modulus of less than 2 MPa.

5. The helmet according to claim 4, wherein the decoupling layer has a thickness between 5 mm and 15 mm.

6. The helmet according to claim 1, wherein the decoupling layer is made from expanded polystyrene having a density of less than 20 g/l, expanded polypropylene, polyethylene foam, polyurethane, cross-linked or non-cross-linked polyethylene, an extruded material, or lastly viscoelastic gels, and/or wherein the inner cap is formed from expanded polystyrene, a polyethylene foam, a polyurethane foam, a cross-linked polyethylene or a non-cross-linked polyethylene.

7. The helmet according to claim 1, wherein the fastening frame is attached on the inner cap by gluing or overmolding.

8. The helmet according to claim 1, wherein the fastening frame is attached on an inner surface or on an outer surface of the inner cap.

9. The helmet according to claim 1, wherein the fastening frame joins the two opposing points and alternatingly passes over an outer surface of the inner cap and over an inner surface of the inner cap, the fastening frame comprising upper parts overlapping the outer surface of the inner cap and lower parts overlapping the inner surface of the inner cap, the fastening frame comprises intermediate parts passing through the inner cap and being attached to the inner layer, each intermediate part joining one of the upper parts to one of the lower parts.

10. The helmet according to claim 1, wherein the fastening frame is a net or a weave or a membrane.

11. The helmet according to claim 1, comprising an outer shell attached to the outer cap.

12. The helmet according to claim 11, wherein the inner cap and the outer cap each respectively extend up to a peripheral free edge , the outer shell , the outer cap or the inner cap comprising a deformable and/or breakable coupling covering the free edges of the inner cap and the outer cap.

13. The helmet according to claim 1, wherein the fastening strap comprises two parts connectable to one another and separable using an attachment system able to be actuated by the wearer, at least one of the parts comprising several branches connected to one another.

14. The helmet according to claim 13, wherein said branches are attached on the inner cap by the fastening frame, at a plurality of separate points.

15. The helmet according to claim 14, wherein said branches are attached on the inner cap by the fastening frame, at four to six separate points.

16. The helmet according to claim 1, including at least one connecting element secured to the inner cap and the outer cap and passing through the decoupling layer, the connecting element being longer than the thickness of the decoupling layer and having a modulus of elasticity of between 150 GPa and 250 GPa, and a limit of elasticity of between 200 MPa and 270 MPa.

17. The helmet according to claim 1, wherein the outer cap has an elastic behavior for a deformation of less than 10%, the Young's modulus then being between 2.5 MPa and 10 MPa, the elastic limit of the outer cap being between 0.25 MPa and 1 MPa.

18. The helmet according to claim 1, wherein the curve of the stress behavior law as a function of the deformation of the decoupling layer is defined in a corridor framed by a first curve and a second curve, the first curve having a slope of 0.5 MPa for a deformation of less than 10%, a plateau at 0.05 MPa for a deformation of between 10% and 90%, and a slope of 20 MPa for a deformation greater than 90%, the second curve having a slope of 5 MPa for a deformation of less than 10%, a plateau at 0.5 MPa for a deformation of between 10% and 50%, and a slope of 10 MPa for a deformation greater than 50%.

19. The helmet according to claim 1, wherein the thickness of at least a region of the inner cap and the thickness of at least a region of the outer cap are respectively greater than the maximal thickness of the decoupling layer.

20. A protective helmet comprising at least one inner cap configured to be placed in contact with the head of a wearer, an outer cap and a decoupling layer interposed between the inner cap and the outer cap, the decoupling layer being capable of allowing the outer cap to rotate relative to the inner cap about any axis of rotation in the event of an impact, at least one spherical surface extending to the periphery of the decoupling layer while being completely contained in the decoupling layer, the helmet comprising:

a fastening strap attached at least at two opposing points of the inner cap without any mechanical connection with the outer cap, the fastening strap being configured to fasten the helmet to the head of the wearer; and a fastening frame attached to the inner cap, the fastening strap being attached to the inner cap by the fastening frame;

wherein the helmet includes at least one connecting element secured to the inner cap and the outer cap and passing through the decoupling layer, the connecting element being longer than the thickness of the decoupling layer and having a modulus of elasticity of between 150 GPa and 250 GPa, and a limit of elasticity of between 200 MPa and 270 MPa.

21. The helmet according to claim 20, wherein the decoupling layer is discontinuous and includes studs extending between the inner cap and the outer cap, and/or wherein the decoupling layer is provided with holes.

* * * * *